United States Patent [19]

Merrill et al.

[11] Patent Number: 4,969,576

[45] Date of Patent: Nov. 13, 1990

[54] METHOD AND APPARATUS FOR DISPENSING COLD BEVERAGE

[75] Inventors: Terry L. Merrill, Anoka, Minn.; Kenneth W. Schneider, Mason City, Iowa; Karl A. Senghaas, San Antonio, Tex.

[73] Assignee: The Cornelius Company, Anoka, Minn.

[21] Appl. No.: 284,969

[22] Filed: Dec. 15, 1988

[51] Int. Cl.[5] ..... B67D 7/00; B67D 5/08; B67D 5/62; G04C 23/00

[52] U.S. Cl. ..... 222/1; 222/54; 222/129.1; 222/129.4; 222/146.6; 222/641; 222/644; 62/127; 62/390

[58] Field of Search ..... 222/1, 52, 54, 63, 638–641, 222/644, 129.1–129.4, 146.1, 146.6; 62/389, 390, 126, 127, 129, 130, 158, 231; 141/100, 105, 106

[56] References Cited

U.S. PATENT DOCUMENTS

| | | | |
|---|---|---|---|
| 2,830,528 | 4/1958 | Arnett | 222/640 |
| 2,949,137 | 8/1960 | Arnett et al. | 222/54 |
| 3,100,383 | 8/1963 | Foster et al. | 62/127 |
| 3,570,715 | 3/1971 | Evens | 222/54 |
| 4,148,334 | 4/1979 | Richards | 222/129.1 |
| 4,216,879 | 8/1980 | McMillin | 222/146.6 |
| 4,387,578 | 6/1983 | Paddock | 62/127 |
| 4,555,045 | 11/1985 | Rodth et al. | 222/146.6 |
| 4,632,275 | 12/1986 | Parks | 222/52 |
| 4,649,809 | 3/1987 | Kanezashi | 222/129.4 |
| 4,676,400 | 6/1987 | Lamont et al. | 62/390 |

*Primary Examiner*—Joseph J. Rolla
*Assistant Examiner*—Steven M. Reiss
*Attorney, Agent, or Firm*—Sten E. Hakanson; Henry C. Kovar

[57] ABSTRACT

The present invention discloses a method and apparatus for maintaining cold carbonated water in a beverage dispensing device so that unacceptably warm water is not dispensed therefrom. A modified beverage dispensing apparatus is shown including a carbonated water supply, a cold plate, carbonated water supply line extending through the cold plate, and in fluid communication with a carbonated water plenum immediately adjacent and in fluid communication with a plurality of beverage dispensing valves. An electronic control device connected to a temperature sensing thermostat located in the plenum and to a solenoid discharge valve of the plenum. The control device is also connected to a temperature sensing thermostat in the cold plate and to a pressure sensor located in the line between the source of compressed carbon dioxide and the carbonated water reservoir. In operation, the control device provides for sensing of the temperature in the plenum so that the solenoid valve can be operated to discharge carbonated water from the plenum if the temperature thereof rises above a predetermined value. So that the water therein can be replaced by water of a suitable lower temperature. The control device also senses cold plate temperature and CO2 pressure so that unacceptably high temperature or low pressure respectively thereof is indicated to the operator and so that the control device can interrupt beverage dispensing.

31 Claims, 4 Drawing Sheets

METHOD AND APPARATUS FOR DISPENSING COLD BEVERAGE

BACKGROUND OF THE INVENTION

1. FIELD OF THE INVENTION

This invention pertains to a method of and improved apparatus for dispensing cold beverage wherein dispensing heads are spaced from a cooling structure and a control has function and structure for keeping cold water at the dispensing head by periodically drawing off warm water.

2. THE PRIOR ART

Cold beverage dispensing systems are old, well known and in extensive use by beverage retailers. A typical installation has a discrete beverage cooling device such as an ice cooled cold plate or coils submerged in an ice and water bath. A group of dispensing valves or heads are located a short distance from the cooler. As an example, the heads will be in a tower about two feet above a counter and the cold plate will be below the counter-top. If a water and ice bath cooler is used, it will probably be on the floor under the counter. There typically is a length of hose from the cooler to the dispensing heads. The hoses will typically be in the range of two to six feet long.

There is an emerging preference by many of the fast food retailers for ice cooled beverage equipment. This equipment is the least costly, takes the least counter space, is the most reliable, is the quietest, and puts no heat into the interior of a retailing facility.

When the dispensing heads are spaced and remote from the cooler, the heads are also remote from the cooling. If the heads are dispensing respectively, they and the beverage being dispensed there through are kept cold by the repetitive flow of cold beverage if and when dispensing is repetitive, there usually is no problem with keeping the dispensed beverage cold. Periods of repetitive dispensing include breakfast, lunch and evening eating times.

Periods of inactivity, such as between breakfast and lunch, between lunch and evening, and overnight cause severe problems with warm beverage. The beverage dispensing heads warm up to ambient temperature as does the beverage in the head. The beverage in the lines leading from the cooler to the dispensing heads also warms up to a temperature close to ambient. Consequently, when a customer shows up and wants a drink, the beverage is warm and will foam when dispensed. A standard acceptable upper limit for temperature of carbonated beverages is 40 degrees F. (4.5 degrees C.). A casually drawn drink during a period of relative inactivity may have a temperature approaching ambient. It is true that this warm drink can be poured over ice, but when this is done there is a significant loss of carbonation and dilution of the beverage with melted ice. This is unacceptable to the soft drink companies and the customer does not get the quality beverage expected. The retailer simply is not serving the quality expected by the public, and the quality the soft drink companies want served.

At the start of the business day, the retailer will have to draw off several drinks to get the dispensed drink temperature acceptable. These drinks are waste and usually are disposed of down the drain. One day may not be bad, but three times a day, 365 days a year and it is easy to see how this adds up to a measurable and significant increase in the cost of goods sold to a retailer. Further, the retailer has a somewhat unpredictable dispenser in that it really is not known if the drinks will be cold or warm, and what temperature they will be at, and whether or not they will foam, and how much ice will be needed in the cup.

There are further problems with ice cooled dispensers in that nothing is available to indicate whether or not the cold plate is out of ice, or if the ice has bridged and cooling has been temporarily lost. Typically, the retailer has to assume something is wrong, when the dispenser starts foaming. In this type of equipment, there is nothing available to indicate when carbonation pressure is too low. There simply is no drink quality control equipment an technique for ice cooled beverage dispensing equipment. There is no equipment and system and/or technique for ice cooled beverage dispensing wherein the temperature of the drink is maintained at within a desirable range of cold serving temperatures, regardless of dispensing frequency.

OBJECTS OF THE INVENTION

It is an object of the present invention to provide a method of dispensing cold beverages with sensing of cooled water temperature and removal of warmed water for keeping cold water at (he dispensing heads.

It is an object of the present invention to provide a method of dispensing ice cooled cold beverage with sensing of the temperature of a cold plate and indicating if and when the temperature is not acceptable.

It is an object of the present invention to provide a method of dispensing ice cooled cold beverage and disabling the dispensing heads if temperature or carbonation is undesirable.

It is an object of the present invention to provide a method of dispensing with storing of cooled water in a plenum behind the dispensing heads, sensing the water temperature in the plenum, and removing the water from the plenum when and if the water gets too warm.

It is an object of the present invention to provide an improved dispenser having a water plenum behind the dispensing heads, structure for sensing the temperature of water in the plenum, and structure for keeping cold water for dispensing in the plenum.

It is an object of the present invention to provide a dispenser having an ice cooled cold plate, a plate temperature sensor, and an indicator for showing the plate temperature is excessive.

It is an object of the present invention to provide a cold beverage dispenser having a carbonator, a sensor for carbonation pressure, an indicator for showing carbonation pressure is too low, and a time delay between the sensor and indicator for prevention of false indication.

It is an object of the present invention to provide a cold beverage dispenser having a water cooler, a dispensing head, a cooler water temperature sensor, and automatic structure for keeping cold water at inlets to the dispensing head by removing warmed water and replacing it with cold water.

It is an object of the present invention to provide a cold water manifold for beverage dispenser, in which the manifold has a water plenum, a water inlet, a water outlet for a dispensing head, a discrete water outlet for a drawoff, and structure for a temperature sensor by the draw-off outlet.

It is an object of the present invention to provide a control for a water draw off structure and function to keep cold water at a beverage dispensing head.

It is an object of the present invention to provide a cold beverage dispenser control with a cold plate temperature sensor and indicator for showing the plate to be too warm.

It is an object of the present invention to provide a control for reliably indicating carbonation pressure is too low.

It is an object of the present invention to provide a kit for retrofitting an existing cold beverage dispenser into an improved dispenser having structure and function to keep cold water at the dispensing heads.

It is an object of the present invention to provide a method of retrofitting an existing dispenser into an improved dispenser having structure and function for keeping cold water at the dispensing heads.

It is an object of the present invention to provide a new electronic control for a beverage dispensing system.

SUMMARY OF THE INVENTION

A method of dispensing cold carbonated beverage has the steps of providing previously cooled carbonated water to a dispensing head, sensing the temperature of the water adjacent the head, drawing off a quantity of warmed up but previously cooled water adjacent to the dispensing head, and replacing the drawn off water with new cold water until the water temperature is at or below an acceptable temperature limit.

A method of dispensing beverage has the steps of ice cooling beverage with a cold plate, sensing cold plate temperature, and indicated whether or not the sensed temperature is proper.

A method of dispensing has the steps of sensing the supply pressure of carbon dioxide gas, disabling dispensing after sending too low a pressure for a predetermined timed period.

A method of dispensing has the steps of storing cold water in a plenum immediately upstream of a dispensing head, sensing the plenum temperature and periodically replacing the plenum water in response to sensed temperatures.

Apparatus for dispensing has a cold water manifold, a temperature sensor for sensing the manifold water temperature, and a temperature responsive control for periodically replacing warm water with cold water in the manifold.

Apparatus for dispensing has a cold plate, a cold plate temperature sensor, and structure for indicating whether or not the cold plate temperature is proper.

Apparatus for dispensing has a C02 pressure sensor connected to a time delay and disabling structure actuatable after the time delay.

Apparatus for dispensing has a beverage cooler, a dispensing head spaced from the cooler, a water temperature sensor adjacent to the dispensing head, and an automatic structure to draw off the warm water and replace it with cold water.

A dispenser control apparatus and method has a transducer for sensing water temperature adjacent a dispensing head, a switch responsive to the sensed water temperature, a water draw off valve connected to the switch, and structure for disconnecting the valve to reclose it after draw off of warm water.

A kit and method for retrofitting an existing dispenser has an electronic control with a water temperature sensor to be installed on a water manifold at the dispensing heads, a normally closed water dump valve to be fluidly connected to the water manifold and operatively connected to the control, and logic in the control for opening the dump valve when the sensed manifold water temperature is too high.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

A method of dispensing cold carbonated beverage has the steps of providing previously cooled beverage to a dispensing head, cooling the beverage with ice on a cold plate, sensing the temperature of the cold plate, and indicating whether the plate temperature is proper or too warm.

A method of dispensing cold carbonated beverage has the steps of providing a supply.

DESCRIPTION OF THE PREFERRED EMBODIMENT

Figure 1:
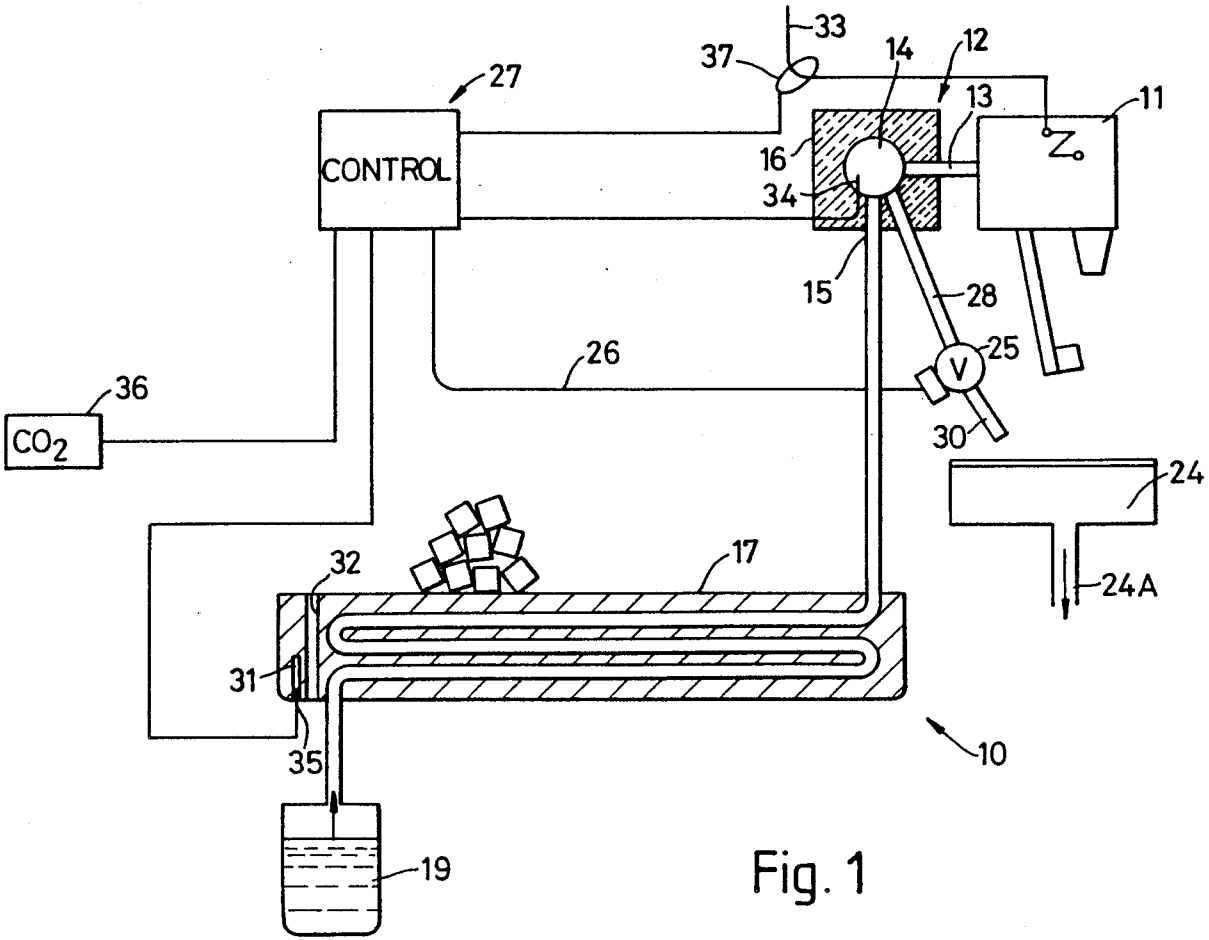
FIG. 1 is a side elevations view of the cold beverage dispensing system of the present invention, shown schematically.
Figure 2:
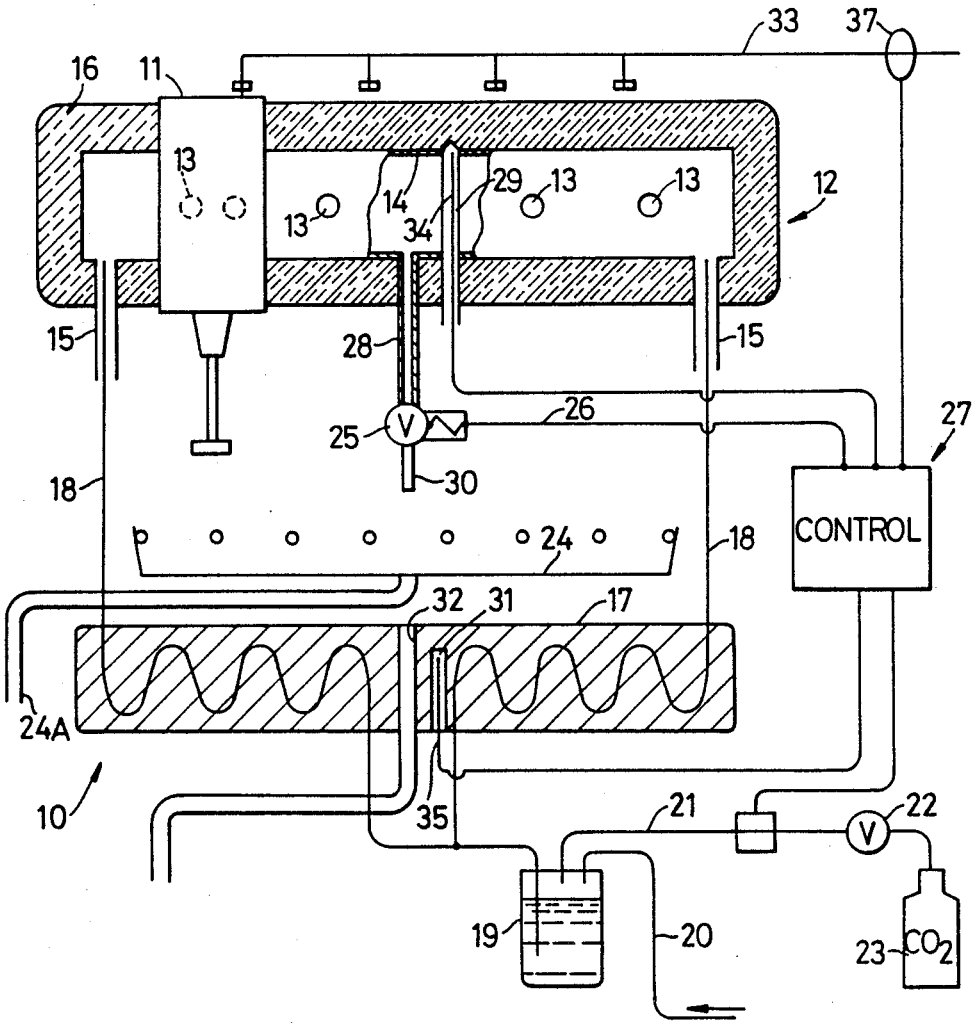
FIG. 2 is a frontal elevational view of the structure of FIG. 1, also in schematic.
Figure 3:
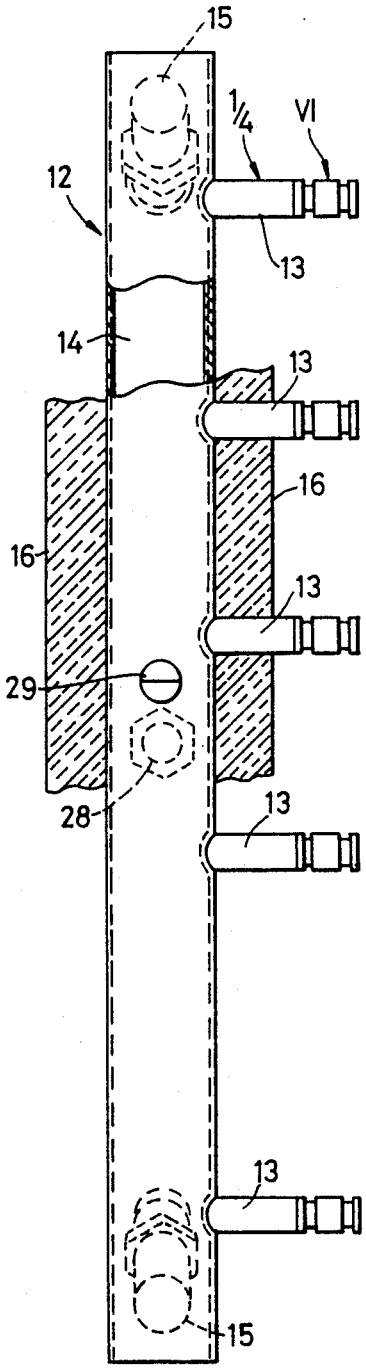
FIG. 3 is a top plan view of the preferred water manifold of the structure of FIG l.
Figure 4:
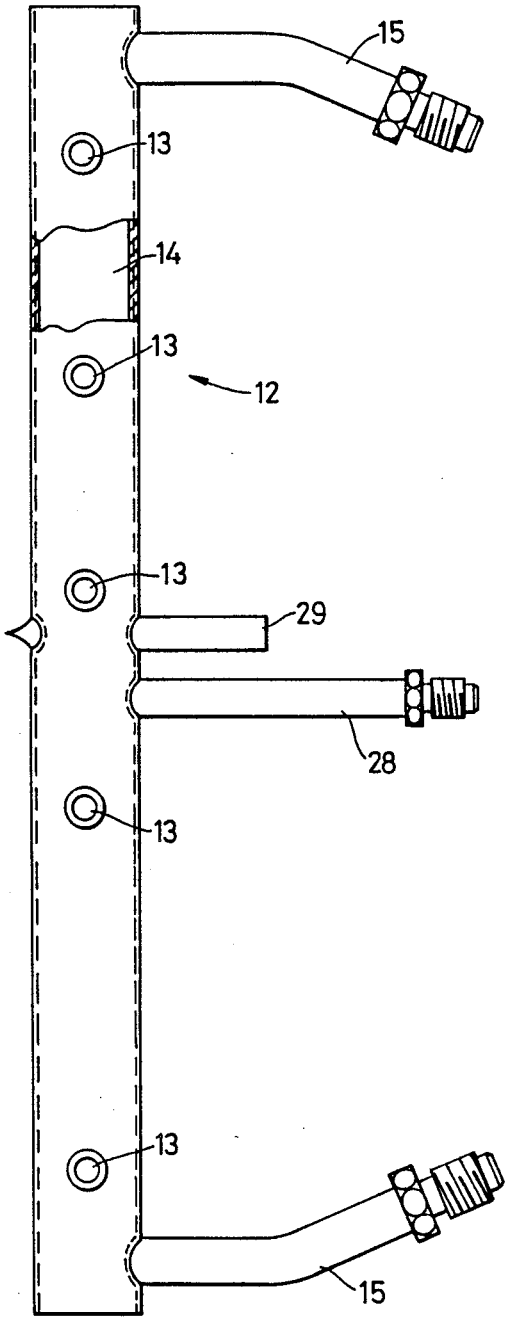
FIG. 4 is a front elevational plan view of the manifold of FIG. 3.

The principles of this invention are particularly useful when embodied in a cold beverage dispenser, such as is shown diagramatically in FIGS. 1 & 2 and which is generally indicated by the numeral 10.

The dispenser 10 has one or more dispensing valves or heads 11, hereinafter referred generically as the head 11. Each head 11, and there usually is a plurality of them with four, five, six, eight, twelve, and even more being common quantities encountered, is fluidly connected to a water manifold 12 by a water tube 13. The manifold 12 is a transverse elongate tube having an internal water plenum 14 from which an individual water tube 13 extends forward to each respective head il. Each end of the manifold 12 has a water inlet 15 into the plenum 14. The plenum 14 is wrapped by an effective layer of thermal insulation 16. An ice cooled cold plate 17 cools water and syrup and supplies cooled water to the manifold 12 by a pair of supply lines 18 directed one each to each of the pair of water inlets 15. The cold plate 17 is connectible to and is supplied water by a carbonator 19 or other source of water or beverage to be cooled. The carbonator 19 is supplied water by a water line 20, and is supplied carbon dioxide gas by a gas supply line 21, pressure regulator 22 and gas bottler 23. Underneath the heads 11 is a cup rest and a drip tray 24 having an outlet leading to a sanitary drain. The cold plate 17 typically is within some type of a box (not shown) so that ice cubes can be stacked on top of the cold plate 17.

An important feature of this invention is the solenoid powered dump valve 25 which is operatively connected by a lead 26 to a control generally indicated by the numeral 27. The dump valve 25 is preferably normally closed and is fluidly connected into the plenum 14 by a singular water outlet 28. The water outlet 28 is located centrally along the length of the manifold 12 and is spaced from and in between the water inlets 15. A thermal sensor well 29 is mounted to the manifold 12 and extends into and through the plenum 14 immediately adjacent to the water outlet 28. The manifold 12 has an enlarged plenum 14 with an anomalous cross section and volume. The plenum 14 is formed of a length of tubing of at least 0.75 inch (18.75 MM) outer diameter so that the plenum 14 holds a reasonable quantity of water and acts somewhat as a heat sink. The water inlets 15 are preferably both 0.375 inch (9.4 MM) diameter and the water outlet 28 is 0.25 inch (6 MM) diameter. A dump water drain 30 extends from the water dump valve 25 to the drip tray 24 and therefore to the sanitary drain 24A.

The control 27 as shown in FIGS. 1 & 2, has a temperature sensing thermister 34 extending to and within the plenum well 29. A second temperature sensing thermister 35 extends to and within a temperature well 31 in the cold plate and adjacent to a melt water drain 32. A pressure sensing transducer 36 is installed in the carbon dioxide gas line 21 and is exposed to the regulated pressure of carbon dioxide gas supplied to the carbonator 19, and the sensed pressure is fed to the control 27. A current sensing transducer 37 is connected to the control 27 and is arranged to sense electrical current in the power line 33 to all of the dispensing heads 11.

Figure 5:
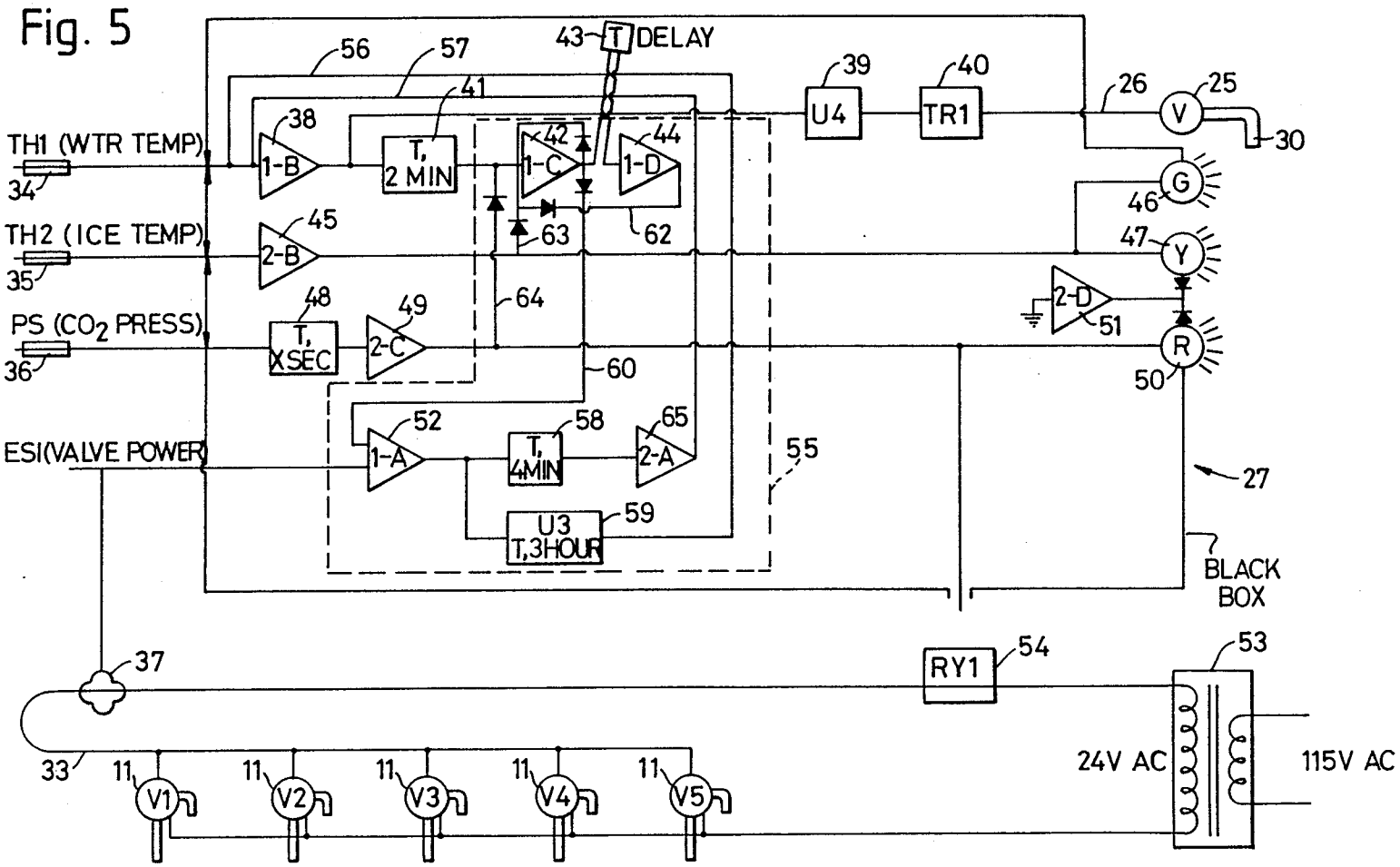
FIG. 5 is a schematic of the sensors and electronics of the system of FIG l.

The logic of the control 27 is depicted in FIG. 5. The plenum thermister 34 feeds into an amplifier 38 which has its output connected to a triac driver 39 which in turn turns on a triac 40 which effects opening of the water dump valve 25. The output of the amplifier 38 is also connected to a water dump timer 41. The output of the dump timer 41 leads to a dump timer amplifier 42 having an output leading to a time delay 43 and then to a reset switch 44.

The cold plate temperature thermister 35 is connected to an amplifier 45 which has its output connected to a green LED 46 and to a yellow LED 47.

The carbon dioxide pressure transducer 36 is connected to a pressure drop timer 48 which has its output connected to a pressure drop amplifier 49. The output of amplifier 49 goes to a red LED 50. Both the yellow LED 47 and red LED 50 are connected to a common oscillator 51 which makes the yellow LED 47 and red LEd 50 blink when energized.

The current sensing transducer 37 is operatively connected to a dispensing amplifier 52. It can be seen that the power line 33 to the dispensing heads 11 comes from a 24V transformer 53 and extends through a normally closed relay 54.

During normal operation of the dispenser 10, the dispensing heads 11 are repetitively opened and cold water repetitively flows into, through and out of the manifold 12 and out of the heads 11. The plenum 14 is normally filled with cold water at a temperature in the range of 32–40 degrees F. (0–4.5 degrees C.). However, if and when a dispensing head 11 is not utilized for some period of time, say ½ hour, the temperature of water in the plenum will warm to above 40 degrees F. (4.5 degrees C.). Plenum temperature sensor 34 will turn on amplifier 38 when its sensed temperature exceeds a predetermined limit, say 40 degrees F. (4.5 degrees C.) and effect opening of the dump valve 25. The warm water in the plenum 14 is removed and drawn off and discharged into the drip tray 24 and is replaced with cold water from the cold plate 17.

When the thermister 34 signals the amplifier 38 that the plenum temperature has returned to below the acceptable limit, the amplifier 38 shuts off and the dump valve 25 is closed.

When the cold plate temperature sensor 35 and amplifier 45 signal that the cold plate temperature is at or below 40 degrees F. (4.5 degrees C.), the green LED 46 is energized. When the sensor 35 and amplifier 45 signal the cold plate temperature is above 40 degrees F. (4.5 degrees C.), the green LED 46 is turned off and the flashing yellow LED 47 is turned on. The user of the dispenser 10 then has to add ice on the cold plate 17 or check for ice bridging above the cold plate 17 which may have caused temporary loss of cooling.

When the carbon dioxide pressure is at or above an acceptable limit, for example 70 PSIG, the dispenser 10 works normally. When the sensed pressure drops below the limit, the transducer 36 feeds the "too low" signal to the pressure drop timer 48. If the sensed carbonation pressure stays too low for a predetermined period of time, say 2 minutes, the timer 48 then signals the amplifier 49 which then turns on the flashing red LED 50 indicating "low CO2" and effects opening of the relay 54 so that the dispensing heads 11 no longer have power and are disabled. The operator of the dispenser 10 then sees and knows that the carbon dioxide shortage must be remedied to make the dispenser 10 operative and to maintain the quality of the beverage.

There are several disable functions provided for disabling of the water draw off feature under certain circumstances.

Disable is provided for upon initial cool down, when the cold plate 17 is too warm because its out of ice or the ice has bridged, when carbon dioxide pressure is too low and drink quality would be substandard, immediately after norma dispensing, and in periods of none use.

The disable structure is in the control 27 and is generally indicated by the numeral 55.

The plenum temperature amplifier 38 needs a proper input from each of leads 56 & 57 in order to open the dump valve 25. The input of leads 56 & 57 are controlled by the dispensing amplifier 52. The output of the dispensing amplifier 52 is firstly connected to a pair of timers 58, 59. The first timer 58 is a dispensing delay timer 58 that is a self resetting timer with a predetermined but adjustable constant delay time that may be about 4 minutes. The output of the dispensing delay timer 58 energizes a dispensing delay amplifier which provides the proper signal via lead 57 to the plenum temperature amplifier 38. In operation and after any one of the dispensing heads 11 has been operated, the dispensing amplifier 52 will have started dispensing delay timer 58 on its count down. During the count down of delay timer 58 the signal in lead 57 is withheld and the amplifier 38 cannot open the valve 25.

If another dispensing head 11 is used during the count down by timer 58, the timer 58 is reset and it restarts its count down. It will be appreciated that continual dispensing wherein a head 11 is used at time intervals of less than the count down time of timer 58, the amplifier 38 will be kept disabled and the valve 25 will not be opened. The concept is that continual dispensing keeps cold water in the plenum 14, so why even sense it? The second timer 59 is an idle time or non-use timer 59. If none of the dispensing heads 11 have been used for a relatively long period of time, say three hours, it's apparent the dispenser 10 is not being used and the non-use timer 59 denies the proper signal in lead 56 and the amplifier 38 is disabled The non use timer 59 comes into play when the retailer closes over-night and during any extended period of non-use. The three hour example is arbitrary; it could be 30 minutes or one hour as desired by the retailer. This feature saves cooling energy and water.

The output of the plenum temperature amplifier 38 is also connected to a water dump timer 41 which is a self resetting timer that will enable actuation of the dump valve 25 only for a predetermined period of time, say 2 minutes. If the sensed plenum temperature has not returned to below the acceptable limit, something is inoperative in cooling of the water and the dump timer 41 shuts off the dump valve 25 by providing an output after its time delay (2 minutes) to a dump timer amplifier 42, the operation of which will be subsequently described.

The dump timer amplifier 42 sends a signal via lead 60 to the dispensing amplifier 52; this signal from amplifier 42 effectively resets and starts the timer 58 which denies the proper signal to the amplifier 38 and causes the dump valve 25 to close.

The output of the dump timer amplifier 42 goes into a latching circuit 61 to hold the amplifier 42 on, and via a timer delay 43 to a reset switch 44 which has a kill circuit 62 to shunt out the latch 61 and de-energize the amplifier 42 after an appropriate short time sufficient to do the various switching of componentry. When the output of the dump timer amplifier 42 is shut off, the dispensing timer 58 is then free to go into and complete its countdown and upon completion of the countdown, the signals are available via leads 56 & 57 to enable the plenum temperature sensor 34 and amplifier 38 to again open the dump valve 25 if and when the sensed plenum temperature exceeds the acceptable limit.

The cold plate temperature amplifier 45 is connected by a one-way plate temperature signal line 63 to the input of the dump timer amplifier 42. If and when the amplifier 45 signals that the cold plate 17 is too warm, the signal is also sent into the dump timer amplifier 42 which in response thereto sends a signal to amplifier 52 resetting timer 58 and disabling the plenum temPerature amplifier 38.

The carbon dioxide pressure transducer 36 and its timer 48 and amplifier 49 are connected by a one way low pressure signal line 64 to the input of the dump timer amplifier 42. A signal from line 64 that carbon dioxide pressure is too low also energizes the dump timer amplifier 42 and as previously described disables the plenum temperature amplifier 38.

When the dispenser 10 has the draw-off feature disabled, it is relatively easy and straight forward to get it back into operation.

If the dispenser 10 has been sitting overnight unused and is off by virtue of the non-use timer 59, a momentary actuation of any one of the dispensing heads 11 will reset and restart the non-use timer 59 and start the dispensing timer 58 on its count down. At the conclusion of the count down by the dispensing timer 58, both signal leads 56, 57 to the amplifier 38 will have the proper signal and amplifier 38 is in condition to effect opening of the valve 25 to bring cold water into the plenum 14.

If the cold plate 17 is too warm, the indicator LED 47 will be flashing and the operator must add ice or break up an ice bridge if there is one. It typically takes about three minutes to cool down a warm cold plate 17 to below 40 degrees F. (4.5 degrees C.). When the cold plate 17 has been cooled below the acceptable limit, the flashing yellow indicator 47 will go off and the green indicator 46 will come on. The dispensing timer 58 will begin its countdown and upon completion of the proper signals are provided to the amplifier 38 and the dump valve 25 can be opened for withdrawing warm water and replacing it with cold water. During the countdown period of the dispensing timer 58, the cold plate 17 continues to cool down from the acceptable limit temperature to a temperature very close to 32 degrees F. (0 degrees C.).

If the carbon dioxide pressure is too low, the gas bottle 23 is changed or the problem is appropriately corrected and upon the carbonation pressure rising to above the predetermined pressure, the signal from amplifier 49 is removed and &he red indicator 50 goes off, the relay 54 closes and the dispensing heads 11 become operable and the disable signal in line 64 is canceled. Thereafter the dispensing timer 58 completes its countdown and the amplifier 38 again becomes operational and able to open the dump valve 25 to maintain cold water in the plenum 14.

A kit for the retrofit of existing dispensers having dispensing heads 11, a remote average cooler and water supply lines 18 will comprise the control 27 with the thermisters and transducers 34, 35, 36, 37, and the manifold 12 and dump valve 25. It must be appreciated that there are tens of thousands of beverage retailers that have existing beverage dispensing equipment with remote cooling wherein the first few drinks drawn during off-times are warm. This retrofit kit will enable the old dispenser to be connected into the system 10 that can be relied upon to always dispense cold drinks when needed.

In the method of installing the retrofit kit and in retrofitting an existing dispenser into an upgraded dispensing system 10 with the draw off feature, the new manifold 12 and dump valve 25 are installed to replace an old manifold, the relay 54 may be placed in the power line if wanted, and the control 27 is installed. The sensors for plenum temperature 34, coolant temperature 35, dispensing sensing 37, and carbonation pressure 36 are then connected and the upgraded and improved dispenser 10 is ready to be put into service.

Figure 6:
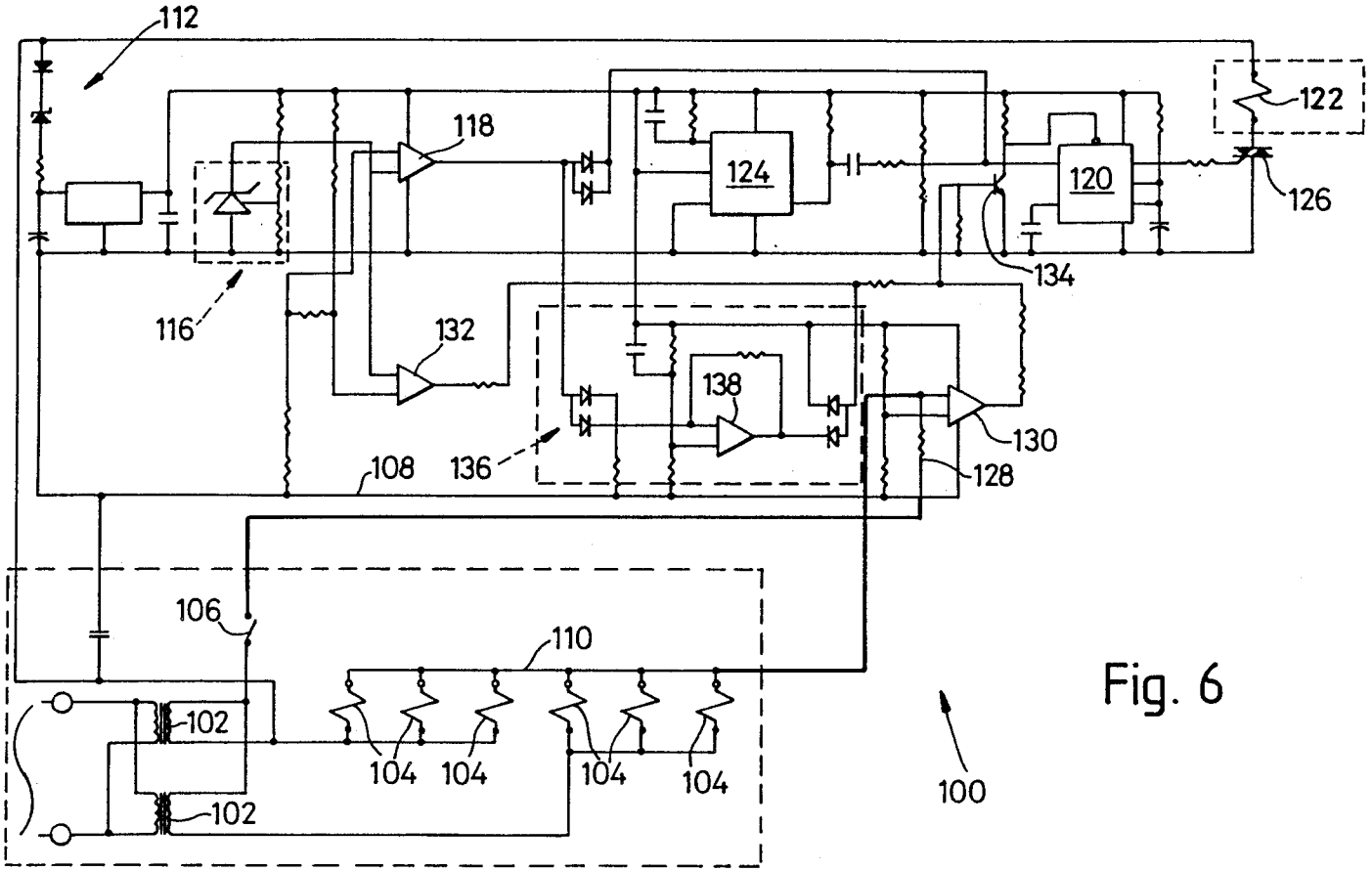
FIG. 6 is a schematic of an alternative electronic control for the dispensing system of FIG. 1.

FIG. 6 is an electronic schematic of an alternative control 100 for an alternative method of operation of the cold beverage dispensing system 10 of FIG 1. A 120 VAC line provides power to at least one and usually two UL-class 2 transformers 102 which convert line voltage to 24 VAC. 24 VAC is desirable to power individual dispensing valve solenoids 104 over an on-off key switch 106 and individual lever or push-button actuation switch or portion controls (not shown) The key switch 106 turns the entire dispensing system 10, dispensing heads 11 and control 100 on or off, and when turned on connects the 24 VAC to both transformers 102 directly to a control circuit common 108 and over diode D1 to a dispense solenoid common 110. The 24 VAC high side is feeding three dispensing solenoids for each individual transformer 102, and also the control 100 circuit high side. Capacitor C8 is a by-pass capacitor for interference suppression.

Diodes D4, D3, resistor R2 and capacitor C3 form a half-wave rectifier circuit 112, changing capacitor C3 to the input voltage level for a 12 volt regulator 114. Capacitor C2 is for noise suppression. An LM335 temperature sensor 116 is physically located in thermal exchange relationship with the manifold 12. Calibration of the temperature sensor 116 is set with resistors R3, R4, R5. An LM358 comparator 118 takes its reference over resistors R6, R7 and receives the manifold and water temperature signal from the sensor 116 on pin 2. As the temperature indicated by sensor 116 rises and attains a specific value for example 40–42 degrees F. (5 degrees C.), the output of the comparator 118 flips high and triggers an LM 555 timer 120 over diode D5. This timer 120, which is a dump valve timer 120, is pre-set to operate for a specific predetermined period of dump valve time, which is preferably less than a minute, is a minority fraction of a minute, and which may be a specific time period of 10 seconds. Pin 3 of valve timer 120 turns on triac 126 causing energizing of the dump valve solenoid 122. This period of dump valve time enables the dump valve solenoid 122 to be predictably energized and then predictably de-energized; i.e., the dump valve 25 will be opened for the time period, say 10 seconds, and then closed. A 2243 cycle timer 124 is operating in an astable mode with its output pin 3 enabling the trigger (pin 2) of the valve timer 120. The cycle timer 124 is pre-set to go through a cycle of greater than a minute but less than an hour. The preferred time is a minority fraction of an hour and may be two minutes. Every time the cycle timer 124 repeats, the valve timer 120 will be enabled. Thus, for example, as long as the temperature sensed and indicated by the sensor 116 is above the low limit set point; i.e., 42 degrees F., the dump valve 25 will be turned on for 10 seconds every 2 minutes.

When the dump valve 25 is opened there will be a pressure drop in the water manifold 12 and to prevent variation of the ratio of water to syrup dispensed, a disable circuit as follows disables the dump valve 25 to restore full dispensing water pressure. A sense resistor 128 is connected in between control common 108 and dispenser solenoid common 110 and looks at the solenoid current and drops a small millivoltage to indicate "a solenoid 104 ON" condition. This "ON" signal is presented to a LM358N op-amp 130 at pin 3, and which when compared to a reference signal on pin 2, causes pin 1 to go high an disable the valve timer 120 over a 2N2222 transistor 134 whenever a beverage is being dispensed. This specific feature and function is the subject of co-pending U.S. Ser. No. 07/286,438, filed on Dec. 16th, 1988.

A high temperature LM358N comparator 132 also looks at the temperature signal from sensor 116 and will go high and disable the valve timer 120 over the transistor 134 as soon a the signal from sensor 116 indicates the water temperature to have attained a high temperature limit indicative of an "out-of-ice" situation. A specific example of a high temp limit is 50 degrees F. (10 degrees C.). Operation of the high temp comparator 132 is precluded during initial start up of the dispensing system 10 by a power up high temperature suppression circuit 136 having a latching op-amp 138.

This alternative electronic control is the subject of co-pending U.S. Ser. No. 07/286,438, filed Dec. 16th, 1988.

Figure 7:
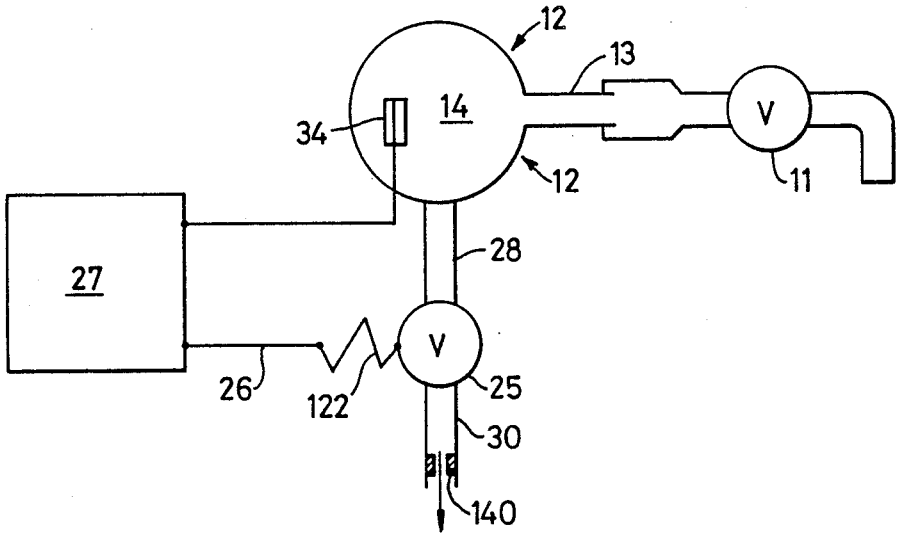
FIG. 7 is an alternative water disposal valve for use with the dispensing system of FIG. 1.

The dump water outlet 30A used with the control is fitted with a water flow regulator 140 as is shown in FIGURE 7. The preferred flow regulator 140 is a collapsible elastomeric washer well known in the beverage industry. A preferred flow rate for regulator 140 is in the range of 0.25 to 1.25 oz/sec; a specific preferred flow rate is 0.65 oz/sec.

The combination of the timers 120, 124 and the flow regulator 140 with the dump valve 25 uses a precise quantity of water each cycle and each unit of time. For example a flow rate of 0.65 oz/sec. for 10 seconds is 6½ ounces or about one glass or cup of water. The flow of water is removed and dumped, replaced, stopped and then the sensor 116 is given time to stabilize and find the true temperature, then, after almost 2 minutes, the temperature is checked again. In any event, the quantity of water removed and replaced is greater than the quantity stored in the manifold 12 and the water inlets 15.

The advantages of the alternative and fully electronic control 100 in the dispensing system 10 are several. It uses less water, requires less refrigeration, has less pressure surges/drops, occurs only for short periods of time, does not overrun past the reaction of the sensor 116, can be much easier retrofitted to existing dispenser systems, does not require a special cold plate, and is probably of lower cost.

An alternative kit for conversion of an existing dispenser into a dispensing system 10 with the control 100 will include the control 100, the dump valve 25, discharge line 30A and flow control 140. Some existing dispensers have the key switch 106; if not the key switch 106 will be included.

Installation of the alternative kit is relatively easy. The control 100 is mounted, the temperature sensor 116 is positioned in contact with the existing water manifold, the dump valve 24, flow control 140 and dump tube 30A are installed, and the appropriate electrical leads are connected.

The advantages are many. Both new and old dispensers can be equipped with this invention. Warm drinks and foaming problems are solved. Cost is modest and value is high.

Although other advantages may be found and realized and various modifications may be suggested by those versed in the art, it should be understood that we wish to embody within the scope of the patent warranted hereon, all such embodiments as reasonably and properly come within the scope of our contributions to the art.

We claim as our invention

1. A method of dispensing cold carbonated water, comprising the steps of:

providing for a pressurized source of carbon dioxide, providing for a source of potable water, mixing the carbon dioxide and the water to provide for a supply of carbonated water, providing for a flow of carbonated water from the carbonated water supply to a manifold, the manifold having at least one dispensing valve in fluid communication therewith, cooling the carbonated water as it flows from the carbonated water supply to the manifold, sensing the temperature of the carbonated water in the manifold, dumping the carbonated water from the manifold through a dump valve in fluid communication with the manifold, if the temperature of the carbonated water in the manifold exceeds a predetermined temperature value, terminating the dumping of the carbonated water from the manifold if the temperature of the carbonated water therein goes below the predetermined temperature value.

2. The method as defined in claim 1, and further including opening the dump valve in response to the manifold temperature sensing means for a first set period of time and closing the dump valve after the first set period of time if the temperature of the carbonated water in the manifold does not go below the first predetermined temperature value during the first set period of time.

3. The method as defined in claim 2, and further including the step of disabling the opening of the dump valve for a second set predetermined period of time after each operation of a dispensing valve.

4. The method as defined in claim 3, and further including the step of disabling the operation of the dump valve for preventing the dumping of carbonated water from the manifold if no operation of a dispensing valve is sensed for a third set period of time.

5. The method as defined in claim 4, and further including the steps of cooling the carbonated water by passing the carbonated water through a heat exchanger means as the carbonated water flows from the carbonated water supply to the manifold, and disabling the opening of the dump valve so that carbonated water is not dumped from the manifold if the temperature of the heat exchanger means exceeds a second predetermined temperature value.

6. The method as defined in claim 5, and further including the step of disabling the opening of the dump valve for the second period of time after a point in time at which the heat exchange means exceeds the second predetermined temperature value.

7. The method as defined in claim 6, and further including the steps of sensing the pressure of the carbon dioxide and disabling the operation of the dispensing valve when the carbon dioxide pressure falls below a predetermined pressure value.

8. A method of dispensing cold carbonated water, comprising the steps of:

providing for a pressurized source of carbon dioxide, providing for a source of potable water, mixing the carbon dioxide and the water to provide for a supply of carbonated water, providing for a flow of carbonated water from the carbonated water supply to a manifold, the manifold having at least one dispensing valve in fluid communication therewith, cooling the carbonated water as it flows from the carbonated water supply to the manifold, sensing the temperature of the carbonated water in the manifold, dumping the carbonated water from the manifold through a dump valve for a first predetermined period of time if the temperature of the carbonated water in the manifold exceeds a predetermined temperature value, terminating the dumping of the carbonated water from the manifold for a second period of time from the end of the first period of time, and successively re-opening and closing the dump valve for the first and second periods of time respectively if, when the dump valve is opened during a first period of time, the temperature of the carbonated water in the manifold does not go below the predetermined temperature value.

9. The method as defined in claim 8, and further including the step of disabling the operation of the dispensing valve during any first set period of time when the dump valve is opened.

10. The method as defined in claim 19, and further including the step of disabling the opening of the dump valve for a third predetermined period of time after each operation of a dispensing valve.

11. The method as defined in claim 10, and further including the step of disabling the opening of the dump valve if no operation of a dispensing valve is sensed for a fourth set period of time.

12. The method as defined in claim 11, and further including the steps of cooling the carbonated water by passing the carbonated water through a heat exchange means as it flows from the carbonated water supply to the manifold, sensing the temperature of the heat exchange means, disabling the opening of the dump valve so that carbonated water is not dumped from the manifold if the temperature of the heat exchange means exceeds a second predetermined value.

13. The method as defined in claim 12, and further including the step of disabling the opening of the dump valve for the second period of time after a point in time at which the heat exchange means exceeds the second predetermined temperature value.

14. The method as defined in claim 13, and further including the steps of sensing the pressure of the carbon dioxide and disabling the operation of the dispensing valve when the carbon dioxide pressure falls below a predetermined pressure value.

15. A method of dispensing cold carbonated beverage, comprising the steps of:

(a) providing a supply of previously cooled carbonated water to a manifold, the manifold having at least one dispensing valve in fluid communication therewith;

(b) cooling the carbonated water by heat exchange in relation with a cold plate;

(c) sensing the temperature of the cold plate;

(d) indicating that cold plate temperature conditions are proper for dispensing when the sensed temperature is at or below a predetermined acceptable limit;

(e) indicating that cold plate temperature conditions are improper for dispensing when the sensed temperature is above the acceptable limit;

(f) sensing the temperature of the carbonated water in the manifold;

(g) dumping the carbonated water from the manifold to maintain the carbonated water therein below a predetermined temperature;

(h) terminating the dumping of carbonated water when the temperature of the cold plate exceeds the predetermined temperatures.

16. An apparatus for dispensing cold carbonated water, and the like, comprising:

a carbonated water supply connected to a pressurized source of carbon dioxide;

a carbonated water supply line providing fluid communication from the carbonated water supply to a manifold, and the manifold in fluid communication with at least one carbonated water dispensing valve, a heat exchange means, a portion of the supply line in heat exchange relation therewith, the heat exchange means for providing cooling of the carbonated water as the carbonated water flows through the supply line;

a normally closed dump valve connected to the manifold, temperature sensing means connected to the manifold for sensing the temperature of carbonated water held therein, control means connected to the dump valve and the manifold temperature sensing means for opening the dump valve if the temperature of the carbonated water held in the manifold rises above a predetermined temperature value for removing such warmed carbonated water from the manifold, and for closing the dump valve after the temperature of the carbonated water in the manifold goes below the predetermined temperature as further cold carbonated water flows into the manifold from the carbonated water supply.

17. The dispensing apparatus as defined in claim 16 and the control means, further including timing means for sensing the period of time the dump valve is opened by the control means and the timing meáns for opening the dump valve if such period of time exceeds a first predetermined period of time, and for disabling the opening of the dump valve until the manifold temperature sensing means senses a carbonated water temperature below the present level.

18. The dispensing apparatus as defined in claim 17, and further including timing means for disabling the opening of the dump valve for a second predetermined period of time after each operation of a dispensing valve.

19. The dispensing apparatus as defined in claim 18 and the timing means, further including non-use sensing means for disabling the operation of the dump valve if no operation of a dispensing valve is sensed for a third set period of time.

20. The dispensing apparatus as defined in claim 19, and further including a heat exchanger temperature sensing means for sensing the temperature thereof, the heat exchanger temperature sensing means connected to the timing means for disabling opening of the dump valve so that carbonated water is not dumped from the manifold if the temperature of the heat exchanger exceeds a second predetermined value.

21. The dispensing apparatus as defined in claim 20, and further including timing means for disabling the opening of the dump valve for the second period of time after a point in time at which the heat exchanger temperature sensing means first senses that the heat exchanger temperature has risen above the second predetermined temperature value.

22. The dispensing apparatus as defined in claim 21, and further including carbon dioxide pressure sensing means connected between the carbonated water supply, the carbon dioxide pressure sensing means connected to the control means for disabling the operation of the dispensing valve when the carbon dioxide pressure falls below a predetermined pressure.

23. A apparatus for dispensing cold carbonated water, and the like, comprising:

a carbonated water supply connected to a pressurized source of carbon dioxide;

a carbonated water supply line providing fluid communication from the carbonated water supply to a manifold, and the manifold in fluid communication with at least one carbonated water dispensing valve, heat exchange means, a portion of the supply line in heat exchange relation therewith, the heat exchange means for providing cooling of the carbonated water as the carbonated water flows through the uspply line to the manifold;

a normally closed dump valve connected to the manifold;

electronic control means, the control means responsive to a manifold temperature sensing means for opening the dump valve for a first set period of time if the temperature of the carbonated water in the manifold rises above a predetermined temperature value, and for disabling the opening of the dump valve for a second predetermined period of time commencing after the end of the first period and the control circuit for repeatedly re-opening the dump valve for the first set period of time if, after each subsequent second period of time, the carbonated water temperature in the manifold remains above the predetermined temperature value.

24. The apparatus as defined in claim 23 and the control circuit, further including means for disabling the dispensing valve during any first set period of time when the dump valve is opened.

25. The dispensing apparatus as defined in claim 24 and the control circuit, further including means for disabling the opening of the dump valve for a third predetermined period of time after each operation of a dispensing valve.

26. The dispensing apparatus as defined in claim 25, and the control means further including non-use sensing means for disabling the opening of the dump valve if no operation of a dispensing valve is sensed for a fourth set period of time.

27. The dispensing apparatus as defined in claim 26, and further including a heat exchanger temperature sensing means for sensing the temperature thereof, the heat exchanger temperature sensing means connected to the control means for disabling opening of the dump valve so that carbonated water is not dumped from the manifold if the temperature of the heat exchanger exceeds a second predetermined value.

28. The dispensing device as defined in claim 27 and the control, further including means for disabling the opening of the dump valve for the second period of time after a point in time at which the heat exchanger temperature sensing means first senses that the heat exchanger temperature has risen above the second predetermined temperature value.

29. A carbonated water dispensing device as defined in claim 28, and further including carbon dioxide pressure sensing means connected between the carbonated water supply, the carbon dioxide pressure sensing means connected to the control means for disabling the operation of the dispensing valve when the carbon dioxide pressure falls below a predetermined pressure.

30. An apparatus for dispensing cold carbonated beverage having a cold plate for cooling beverage, said plate having an inlet connectible to a source of carbonated water, and having an upper surface for support of ice thereon in direct heat exchange relationship, and an outlet connected by a conduit to a manifold, the manifold in fluid communication with at least one beverage dispensing valve, the improvement comprising means for sensing the temperature of the cold plate;

means responsive to said sensing means for indicating the temperature of the cold plate is either at or below a predetermined acceptable temperature high limit, or above the limit, manifold temperature sensing means for sensing the temperature of carbonated water held therein, dump valve means in fluid communication with the manifold for dumping carbonated water from the manifold in response to the manifold temperature sensing means so that the temperature of the carbonated water in the manifold is held at or below a predetermined temperature, and disabling means connected to the cold plate temperature sensing means or preventing dumping of carbonated water from the manifold by operating of the dump valve in response to the manifold temperature sensing means if the cold plate exceeds a second predetermined temperature.

31. A control for a cold carbonated beverage dispenser, comprising (a) a transducer for sensing the temperature of beverage water immediately upstream of a beverage dispensing head, (b) a switch connected to said transducer, said switch being responsive at a predetermined maximum acceptable sensed temperature limit for providing a draw-off signal, (c) means for operatively connecting said switch to normally closed draw-off valve, for effecting electrical opening of the valve when the draw-off signal is produced; and (d) a timer for disconnecting the draw-off signal after draw off of a quantity of water.

* * * * *